US006524201B2

(12) United States Patent
Fenn

(10) Patent No.: US 6,524,201 B2
(45) Date of Patent: Feb. 25, 2003

(54) DARTS: USER APPLIED MODIFIABLE BODY AND MECHANISM/S

(76) Inventor: George E. Fenn, c/o D. Shutz, 1343 Santa Clara, Richmond, CA (US) 94608

( * ) Notice: Subject to any disclaimer, the term of this patent is extended or adjusted under 35 U.S.C. 154(b) by 0 days.

(21) Appl. No.: 09/781,494

(22) Filed: Feb. 13, 2001

(65) Prior Publication Data

US 2001/0014635 A1 Aug. 16, 2001

Related U.S. Application Data

(63) Continuation-in-part of application No. 09/305,338, filed on Jan. 20, 1999, now Pat. No. 6,277,041.

(51) Int. Cl.[7] ..... A63B 65/02
(52) U.S. Cl. ..... 473/578; 473/582; 473/586
(58) Field of Search ..... 473/578, 582, 473/585, 586, FOR 216, FOR 219, FOR 220, FOR 223

(56) References Cited

U.S. PATENT DOCUMENTS

| | | | | | |
|---|---|---|---|---|---|
| 3,957,271 | A | * | 5/1976 | Kurtz et al. | 473/586 |
| 4,101,126 | A | * | 7/1978 | Kurtz et al. | 473/582 X |
| 4,858,927 | A | * | 8/1989 | Simmons | 473/586 |
| 5,009,433 | A | * | 4/1991 | Reid | 473/582 |
| 5,118,117 | A | * | 6/1992 | Denen | 473/585 |
| 5,271,625 | A | * | 12/1993 | Kurtz et al. | 473/585 |
| 5,505,460 | A | * | 4/1996 | Wolfenden et al. | 473/585 |
| 5,642,887 | A | * | 7/1997 | Orav | 473/586 |
| 6,267,698 | B1 | * | 7/2001 | Orav | 473/578 |

FOREIGN PATENT DOCUMENTS

| | | | |
|---|---|---|---|
| FR | 1194661 | * | 11/1959 |
| GB | 419323 | * | 11/1934 |
| GB | 589629 | * | 6/1947 |
| GB | 599242 | * | 3/1948 |
| GB | 1509198 | * | 5/1978 |
| GB | 2026878 | * | 2/1980 |
| GB | 1590954 | * | 6/1981 |
| GB | 2153693 | * | 8/1985 |
| WO | 21493 | * | 10/1993 |

* cited by examiner

*Primary Examiner*—John A. Ricci

(57) ABSTRACT

A dart includes a barrel, having a blind bore opening into one, or preferably both, ends, the bore closed by a threaded end cap with a passage therethrough, a shaft slidably received in the passage and retained in the bore by an enlarged collar at one end, and an elastomeric cylinder spring bearing against the end of the bore and the collar, to bias the shaft away from the barrel. The shaft may be either a forward scoring pin, or rearward flight shaft. The bore is of a larger diameter than the elastomeric cylinder, to allow compressional flexural movement of the shaft in response to forces imposed on the shaft and barrel, to reduce rejection of the shaft into a dart board, and reduce deflection of subsequently thrown darts which strike the rear shaft, The dart may include a hollow interior to receive a customizable weight body, and a detachable indented grip.

15 Claims, 4 Drawing Sheets

DARTS: USER APPLIED MODIFIABLE BODY AND MECHANISM/S

CROSS REFERENCE TO RELATED APPLICATION

This application is a Continuation-in part of Application Ser. No. 09/305,338, filed Jan. 20, 1999, now U.S. Pat. No. 6,277,041.

DISCUSSION OF THE PRIOR ART

There have been an extremely large variety of advances made in and for the various games of darts. A dart is a hand held tubular projectile having a point, that is generally designed to be thrown at a target for the purposes of scoring within circularly and radially defined impact areas on the target. A typical dart also includes an attachable shaft carrier aft of and axially oriented to the main body which generally carries guidance vanes, called flights, to help stabilize the trajectory of the thrown dart.

In most cases, the advances have been applied to an external shape of the dart. Various materials are used to create the barrel or central segment of the dart body, such as wood, brass, various amalgams, or tungsten. Into these materials are formed various shapes or patterns, designed to enhance the user's grip or finger placement. Shapes may include dish-outs for finger placement or knurling.

Points for darts may be either "soft tip" or "steel tip." The soft tip is usually of plastic, and designed to be used with an electronic scoring board. The steel tip is a hardened metallic member designed to impact a target of densely packed sissal which can accept the scoring point, so that the player can visually establish the value of the thrown dart. A steel tip dart must remain in the target during the player's turn sequence (which may include the throw of multiple darts), to create a score. Both the electronic and sissal target boards include areas of different value separated by thin metal or plastic dividers (sometimes called "spiders"). If a dart directly impacts a divider, it may bounce off the target without sticking or impacting a scoring position. Prior attempts have been made to design darts which will remain in the target even if a divider is struck or, at least, create an impact reference.

In one approach, the soft tip has been formed from a composite of carbon oriented plastic so as to provide a means of flexion when it strikes the target, thereby reducing the chance of rejection by a divider. In this composite dart tip, it has been shown that if the dart tip is sharpened after deformation created by impact with an impediment, the harmonic signature of the dart is changed.

Another prior art point approach, has been to provide means to allow for the axial movement of the point within a forward containment area of the central dart body, with various controls therefor. Several approaches employ a floating point shaft contained in or by a screw-in race, one being a manually applied pinch effect of the taper of the point in an axial bore of the race, where, impact with the target releases the point so as to allow a hammer effect to drive the dart further into the target. Another approach involves an enlarged head on the axial point shaft, either being rounded or drop hammer formed in a manner called peening, with the head being constrained by a screw-in or press fitted race, or obverse placement, or by annularly placed resilient washers, or O-rings. Other approaches, rather than O-rings, have utilized axial placement of resilient strips in machined grooves to engage the shaft's collar in an attempt to slow the impact moment; where, a variation to the O-rings employs radially inwardly projecting fingers that interact with the enlarged collar to control the impact induced moment in the containment cavity. Again, these various structures are employed in a hammering system; but, there is a failure to recognize that this approach, during initial impact with a target or divider, does not allow the linear alignment between the dart's point and body to be altered.

Further, in several of the latter approaches, the O-rings have been placed in a subtending annular race of that enlarged shaft ending head; or, they have been placed in the orienting insert, within a radially outwardly positioned annular raceway; or, they have been placed, in combination, forwardly of that enlarged head and in the raceway. But, in these darts, it is common to find that substantial wear occurs, as the rotation of the variously placed O-rings are working against a stationary shoulder, thereby limiting the value of the point movement.

Another approach has been the usage of a spring body surmounted about a shaft positioner so as to provide an axially oriented progressive loading characteristic for impact with a scoring area. However, springs are known to lose temper due to the short compression cycle experienced by the impact of these darts.

In other darts, the aftward portion of the shaft-ending enlarged head can impact a taper formed cavity ending buttress, this to provide an angular distortion about the body or barrel's axis; a conoid machined shaft that impacts a similarly shaped and obversely positioned conoid body thereaft during impact-induced axial travel, this to provide a non-axial motion when impact with the target's dividers or impediments occurs, particularly in the segments that have the highest scoring value. But, it is known that the use of springs, with their subsequent loss of temper caused by the pico-second impact can and do lose this non-axial utility: both coil springs and metal strips which are constrained against lateral movement outside the axis of the load causes direct loss of that ability.

Also, due to the various construction methods, none of these approaches have the ability to ignore the effects of gravity, which may eliminate their effectiveness, because, when the point is retained in the target board, the body of the dart may be angled downwardly relative to the point, and this body may block subsequent darts thrown toward small areas of high score value.

One such example is the internal and forward use of a resilient cylinder with an axially formed bore receiver for receipt of a point shaft, with the aftward end thereof being rounded, with the resilient body simply push-inserted into a receiver cavity of the dart, and placement being arrested by the round end of the shaft against a buttress. There are no provisions against the elastomeric cylinder's propensity to return to an unloaded state; distortion created by non-axial movement upon impact with a target would cause the cylinder to actually creep out of this position; and, this distortion would tear the bore therein.

Two other approaches employ either a wound spring on the depending shaft of the point, or a flight-carrying shaft; while showing some utility, neither recognizes that heat and/or non-axial loading will cause displacement or breakage of the point. The wound spring, like it's rubberoid counterpart, will actually displace itself from the containment cavity upon lateral displacement. The cupped spring with curved end catchments for the flight shaft, or any half-dome with a central hole receiver for that shaft carrier, faces two considerations: any spring, beyond heat loss, will attempt to return to an unladed state, thereby becoming an impediment that could interfere with the trajectory of subsequent darts; whereas, the fully cupped spring, beyond the increased potential of resistance, actually embodies a buckle effect. In addition, a strip-type spring, like those above, limits the flight-carrying shaft to only two directions of movement, they being along the axis formed by the width thereof.

Regarding the weights and shapes of darts available, there have been more than one approach. One is an end-threaded shaft that connects the fore and aft ends of the barrel. Various axially-bored pieces of varying density are placed along the shaft to create varying weights and shapes. Stability is improved by an )-ring positioned appropriately.

Another employs a similar internal shaft, and has a variety of weight beads that are placed thereon by the user, prior to insertion into an internal cavity of the barrel, where stability is derived, again, by an appropriately positioned O-ring.

Yet another employs various media, in the hammer approach, that are sometimes separated so as to provide a differing method of weight distribution within the internal chamber of the dart.

Then another employs a simple and fixed addition to the internal chamber, from the aft end, the density of which changes relative to the desired weight; but, whose forwardly positioned end in the tapered receiving bore is employed as a buttress, it affecting the point's reaction to impact with the impediments.

Additionally, another approach combines the annular receipt of an O-ring impinging a balled-ended shaft, with that ball impinging upon the forward end created by impact.

Then, there is the combination of a scoring shaft with a peened or formed head that rests on a ball bearing, with the latter imping on a cylindrical rubberoid member, this arrangement supposedly allowing incremental movement of the scoring member during impact; but, due to the inability of the rubberoid member to expand laterally during impact transition, this cylindrical member can explode, thereby limiting its impact control.

In all of the above approaches, while showing some utility, none consider the effect of having a forwardly formed cavity which affects the desired forwardly induced weight differentials. Additionally, because of the possibility of loosening, which can cause rattling and distraction, or the fact that the loss of any one piece can eliminate that dart from play, the utility of the prior are considered minimal at best. And, regarding guidance vanes or flights, there have been a variety of attachment variations: there is a polymer shaft, extending radially aftwardly from the central body, generally being threadably attached, and having forward molded receiver slots in an X-format, it receiving a press-insertion of the flights chosen by the player; or, obversely joined V's, the vertice junction creating a slot for that flight member insertion. And, there have been specialized flight-carrying shafts that receive a tripodal vane rather than the four vanes more commonly used for the guidance of the thrown projectile, this approach limiting the impediments involved in trajectory interference.

Another approach, called SLICKSTICK, employs that shaft but has a slot that is end-bounded that, in turn, receives the "X" flight slipped laterally into and positioned at the aftward end of the slot prior to the player's throw, this allowing forward but non-radial movement created from impact with any subsequently thrown dart. And, after the throw and removal from the target, must be manually moved to the backward station.

One of the first spinning flights, called DYNA-STAR, employs an aftwardly axial shaft that has an enlarged portion thereon for receipt of a pull-molded spline carrying the flights, that is slip-pressed onto and beyond a pinch created shoulder of that shaft carrier. This will allow radial movement created by an incoming projectile thrown in close proximity to an at-rest dart.

There are others that are also rotational about the dart axis; but, none recognize that by the time the impact induces any spinning movement, the dart is well past the point of collision therewith. In addition, spinning about that axis can be a detriment; none take into account that the darts thrown have multiple speeds and trajectories.

IN all of the prior art approaches noted, notwithstanding the displayed utility, the attempts have been to provide the player with a dart that will enhance their application of skills and growth in the game of darts. Yet, there are possible advances to the general application of dart design that will enable the particular user to create a more fully personalized involvement with this enjoyable game, thereby furthering the art of the game and the player's approach towards serious enhancement of their skills.

SUMMARY OF THE INVENTION

The invention employs various embodiments of soft tip and steel tip darts. The darts can be personalized while maintaining the same overall external shape. The darts are designed to greatly reduce or eliminate rejection if the dart hits a divider or other impediment, as well as to have reduced interference with and deflection of subsequently thrown darts to target areas of high value.

This toy projectile is designed to be thrown at a polymer surface having a plethora of holes, in the electronic game; or at a bound sissal target for receiving the steel tip, in the traditional game. Both types of target usually have scoring areas delineated by radial and circumferential spokes (or "spiders"). An important design consideration for the soft tip dart is that the dart must depress a scoring segment, even if initial contact is with a spider; whereas, steel tip darts require that a thrown dart must remain in the board until removed by the player to score, as any dart that falls out during the turn does not count towards a score in that turn.

From my U.S. Pat. No. 6,277,041, against the models and copyright grants of 1994 and 1995 that employed either a cup-like formed rubberoid member mounted to an extended pintle-like shaft or spring surmounting a longer extended pintle shaft, the transition to a cylindrically formed rubber spring body occurred. It was this change, which allows expansion of the elastomeric cylinder within the cavity therefor.

This transition, when coupled to the various weight characteristics that could begin from a static or dynamic reference, created darts that were capable of extreme personalization; but, the outward shape that might employ a "thumb-notch" or "dish-out" could modify the forwardly, central weight chamber into two factions that depend upon the placement thereof, and separate the forward segment from the afterward segment.

The forward segment, established by a pre-tap bore to a specified depth, receives an elastomeric cylinder that has a smaller diameter, thereby allowing lateral expansion created by impact with an impediment. A threadable forecap, having a slide bore receives a shaft with enlarged collar closely fitting said pre-tap bore prior to rotational closure of that ending barrel means; where, closure into the threaded receiver of the barrel end causes contact against the resilient compression member by that enlarged head. Thus, partially loaded by that closure, this silicone derivative of 40 Shore A to 70 Shore A contacts both that enlarged collar and the end buttress formed by a pre-tap bore. And while it is expected that thread-chine considerations would cause tensional closure that would be expected to eliminate loosening, an addition of the known prior art of an O-ring residing on the male thread portion of the end closure and meeting the barrel end would enhance the ability to prevent unwanted rattling at this or any use position. Impact induced forward movement of the completed dart, when the scoring portion of the dart intersects the known impediments ("spiders") that divide the particular scoring areas into discrete parts, allows the much desired player advantage called "hunting-off-of-the-wire" due to progressive loading of the compressional impact controller, thereby allowing a marginal throw to establish a score from the actions created by contiguous thrust considerations.

An alternative would employ the known carrier in a somewhat differing fashion, in that its internal placement abuts the inward radial stop of the forward barrel closure end in a somewhat larger bore, the carrier diameter being slidable therewithin; where, this mutual surface having a reciprocally subtending forwardly taper to facilitate the elimination of any possible wear that might accrue through distortion experienced while the various impact impediments place stress on the axial slide bore found in that forward endcap.

In an additional alternative, by using a much larger bore diameter, the axial bore is enhanced by a forwardly extended tapered bore from a juncture references along the noted reciprocal faces to a position that allows the shaft of the scoring member to become axial when at rest, yet allows both axial and non-axial movement of the completed dart when impacted by and subsequent throw to an area of small incidence, thereby enhancing the scoring capability for the player by reducing any possible resistance during impact with any subsequent arc-thrown projectile, plus, resetting the barrel along the axis after impact for any dart thrown.

In one case, using a concavely mirrored buttress wall axially separating an outwardly threaded portion and inwardly extending thinwall body, a vent bore therethrough, and employing a loc-tite insertion of the threaded portion into a staged bore receiver of the following chamber of the dart body, thereby creating one of multiple end closures for the weight chamber of an aftwardly positioned thumb-grip that is considered a fore weighted thrust biased dart; while, with the thumb notch being forward, the dart is considered as having aft weighted thrust bias. This would, in the first case, require an aftward opening of the weight chamber, whereas the second case would require a forwardly positioned chamber opening, with a simple transference of the body parts attributed to the position of use.

Using the example of the aftwardly placed thrust grip, the weight chamber is a bored tubular tungsten body, of 50/50 to 95/5 in weight distribution, and has a minimum of three internal diameters: the columnar use of an elastomeric cylinder abutting at least one cylindrical wall against a shaft with an enlarged head, said shaft residing in a slide bore of an end closure for a barrel; the use of a carrier with multiple bores receiving both the shaft and enlarged collar and capturing one end of the elastomeric cylinder, with continued use of the en-closing slide bore that is utilized for axial movement by the noted carrier. All three embodiments use external threads for the closure means, they by of a metalloid construction consistent with stress and impact considerations/and there are variations within these sets, as displayed in the drawings.

Again, using the noted aftward thrust reference, the flights carrying portion of this invention employs any or all of the forward positions that are applicable, particularly the axial locus of a shaft with enlarged collar working with a slide bore within a closure body and against an elastomeric cylinder abutting said collar and the cylindrical buttress formed by a pre-tap bore that receives a threadable closure, and, it is the radial clearance between the diameters of the bore and rubberoid body that allow radial expansion which facilitate dispersal of the note impact force; where, the enlarged shoulder is of close fitting means with said pre-tap bore, this to provide an aspect that limits any wear during axial motion in said slide bore by said shaft depending inwardly.

The weight inserts of this invention shall include another embodiment beyond the ability to slidably fill the accepting chamber: A thinwall tube with one opening, the obverse end possibly having reciprocal chamfers as ta centering means outboard of a cup receiver for the receipt of a stabilizing elastomeric cylinder, this body receiving tungsten particulate to a user determined level; a capturing plug body with extended flanges, and a hole therethrough, this having an annular slot on said flanges for receiving an O-ring that eliminates loss of the particulate powder; use of a shaft with enlarged collar intended to be positioned through that axial hole, the shaft having variously spaced annular slot receivers therealong, for use with a circlip that is preceded by an O-ring that prevents the loss of the powder; where, the overall length of this completed weight insert continues the duplex insertion capability, as disclosed in U.S. Pat. No. 6,277,041, as the tension provided by the elastomeric cylinder inserted into the cup receiver provided adequate tension upon threadable closure of the chamber. And, while disclosed as an incremental loading of the fixed, an appropriately changed aspect hereto would be the usage of that elastomeric cylinder separating the loading aspects of this carrier, be they used prior to the insertion of a particulate charge or throughout the weight bias chamber, thereby establishing an axial lengthening of the conoid impact dispersal characteristics.

While the thumb-notch can be attached to either of the thrust value embodiments or others known in prior art, with one end being the threadable means of closure for the established weight chamber, it is very possible that designs considerations that pertain to the player's requirements would determine that this thumb-notch can actually be a separate piece that threadably connects the fore and aft ends of the dart, thereby giving the user one more advantage towards exceptional personalization of their set of three darts.

Within the simplicity of this invention, which further expands its utility, is the utilization of the forwardly found characteristics in the aftward portion of the dart barrel which, in turn, enhances aspects of the flights carrying shaft through impact-induced movement that can be axial and then be considered axial and non-axial, thereby drastically reducing or eliminating any deflection caused by close proximal throws to areas of high scoring value. Again, the impact condition is a wave harmonic expressed herein as a conoid projection shown laterally about the elastomeric controller.

As stipulated in U.S. Pat. No. 6,277,041, this approach is being directed towards the deployment of a kit format. The kit would include the various external and internal components required to create a set of darts, from front to back, or be applied in various segmental ways to applicable prior art values; where, the choices hereto expand the original utility of "3×7($^3$)×3" to this: seven to the eighth power ($^5$) to the seventh power, the value being defined by individual user preferences, thereby creating a personalization factor towards utility for this encompassing invention well beyond current prior ability.

DETAILED DESCRIPTION OF THE INVENTION

Figure 1:
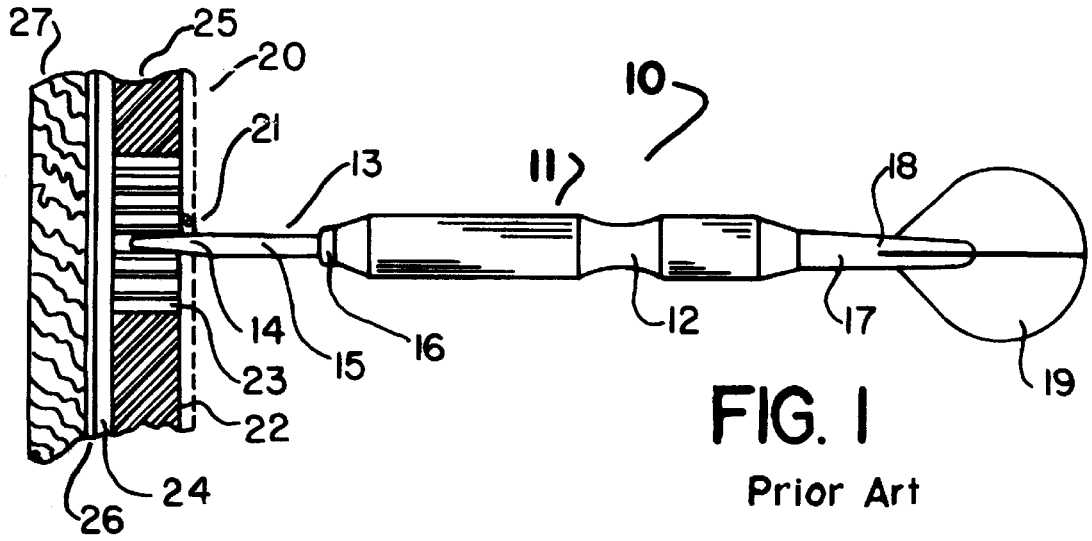
FIG. 1 Prior Art
FIG. 1 shows a prior art soft tip dart received in an electronic scoreboard.

Referring to FIG. 1, this shows a typical dart 10, with a soft tip, comprising a tubular central body or barrel 11 having an aftwardly positioned grip 12 creating a forward thrust or weight bias; screw-in scoring tip 13 with a tapered front 14 and larger shaft 15, and a screw-in collar 16 threadably joined to the barrel. At the rear of the dart is a screw-in flight-carrying shaft 17, with an X-slot 18 for receiving slide in flight 19.

The typical electronic dart board 20 includes a scoring face 22, with areas of different value delineated by boundaries or "spiders" 21. The scoring face includes holes 23 for receiving the dart tip. Impact planes 24 and 25 cooperate with signal plane 26 to record the score. The board is mounted on backing carrier 27.

Figure 2:
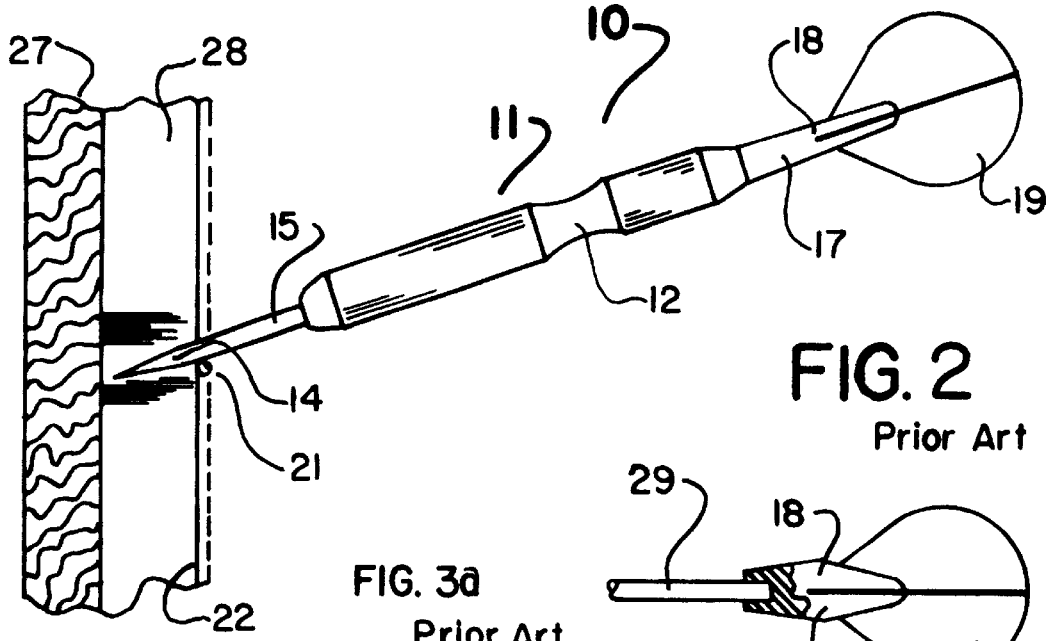
FIG. 2 Prior Art
FIG. 2 shows a prior art steel tip dart received in a sissal scoreboard.

FIG. 2 shows a typical steel tip dart received in a typical sissal board 28, having the same spiders 21 noted above.

Figure 3A:
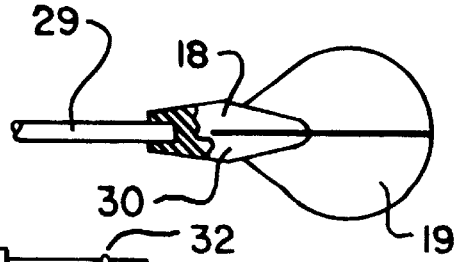
FIG. 3a Prior Art
FIGS. 3*a* and 3*b* show prior art arrangements for attaching dart flights to a shaft.
Figure 3B:
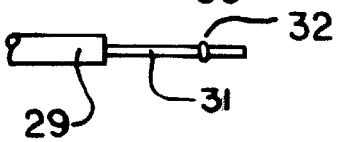
FIG. 3b Prior Art

FIG. 3*a* shows a flight carrying shaft used in the prior art, comprising a round rod 29 for receiving a press fitted carrier 30 having an X-slot 18 to receive flight 19. FIG. 3*b* shows that rod 29 may have a wire 31 extending therefrom, the wire having an indent 32 for receiving DYNA-STAR flights.

Figure 4:
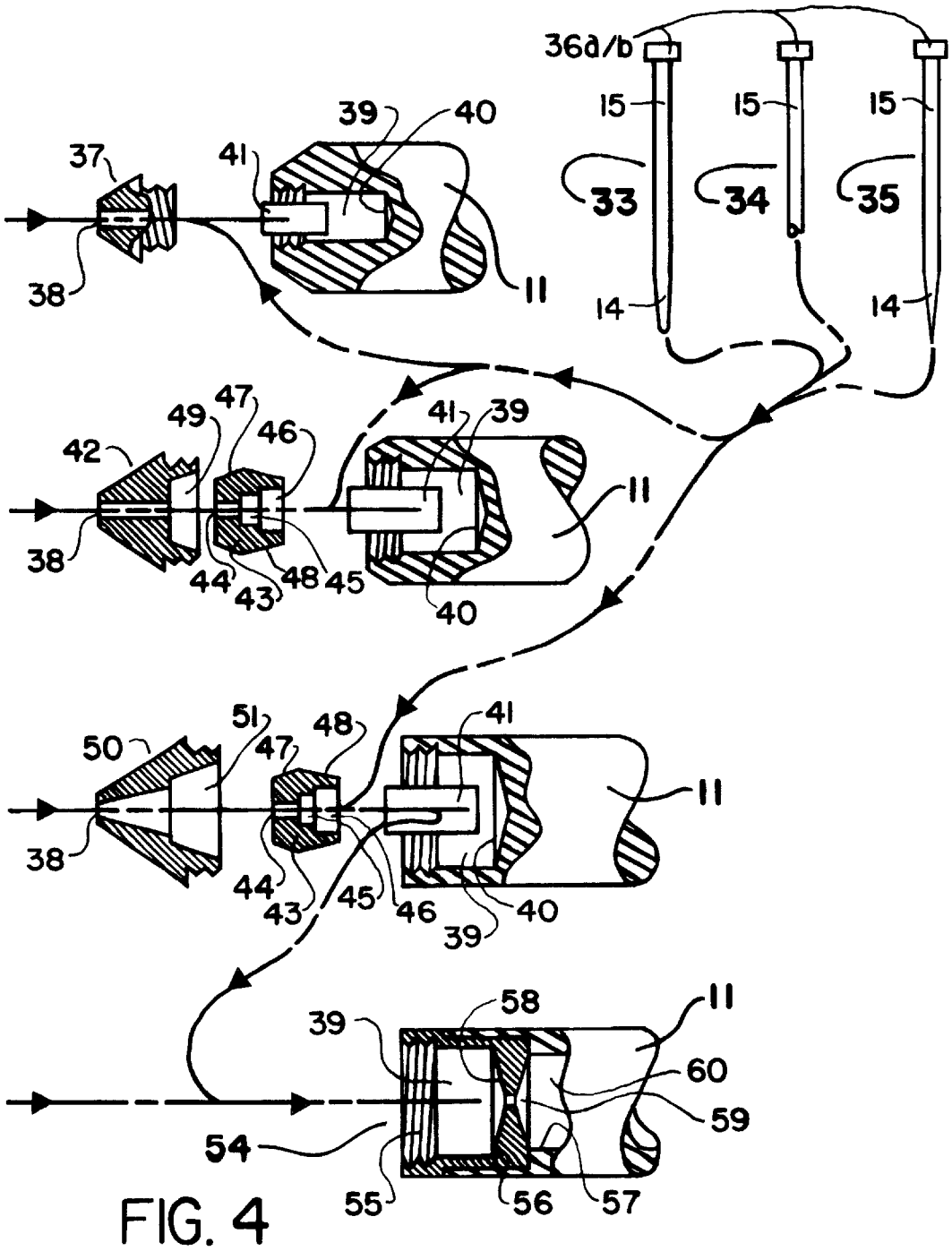
FIG. 4 shows the various dart bodies or barrel endcaps that this invention utilizes in a mix and match fashion for a kit.

FIG. 4, without identifying whether these partial cut-away views are forward or aftward for the barrel end, as the embodiments are cross-relational and determined by the end-user, shows the three shaft assemblies 33, 34 and 35, comprising a shaft 15 having an enlarged collar 36*a*/*b* for controlled placement, the difference between *a* and *b* being integral or click mount fitted to said shaft; where, assembly 33 is a soft tip striking member, assembly 34 is the flight-carrying shaft depending aftwardly from barrel 11, and assembly 35 is a steel tip striking member.

As the placement paths indicate, there is a threadable barrel end closure 37 that has a close fitting slide bore 38 axially therethrough for receiving the determined assembly 33, 34, or 35; where, the pre-tap bore 39 incorporates an end-buttress 40 for containment of an impact controller 41, this elastomeric silicone derivative of 40 Shore A to 70 Shore A also contacting enlarged collar 36*a*/*b* upon rotational closure of the spun-cast aluminum or machined endcap 37. Bore 39 of barrel 11 is close fitting to the enlarged collar 36*a*/*b,* acting like the axial slide bore previously noted; and, lateral clearance for the impact controller 41 allows compressional expansion thereof, without any necessity of an axial locator due to the length of same versus the diameter applied to said bore.

Endcap 42, in a differing approach, employs a carrier 43 of injection molded delrin polymer for receiving shaft 15, said shaft extending through a close fitting bore 44 and engaging a click slot-keeper disclosed in U.S. Pat. No. 6,277,041, the enlarged collar 36*a*/*b* fitting into staged bore 45 of this carrier, and elastomeric cylinder 41 fitting into a larger staged bore 46 of said carrier. Note that carrier 43 has an outwardly subtending slope 47, which has a reciprocal nesting shape 49 that furthers axial alignment, and an inwardly subtending slope 48; where, rotational closure of endcap 42 into body 11 slightly compressions the resilient member 41 that is found in the competed carrier 42 assembly as it contacts buttress wall 40 of a different pre-tap bore 39 diameter, thereby providing a tensional closure means considered finger tight approach. The larger bore 39 allows a higher expansion value for the resilient cylinder 41 during impact with the diameter hereof being a slide bore in relationship to that molded carrier 43 during axial travel derived from impact.

Endcap 50 continues to use that carrier 43 and resilient column 41 abutting a cylindrical wall 40; where, an enlarged nesting receiver 51 continues that axial alignment, whereas a tapered axial bore 52 between slide bore 38 and said nest receiver 51 allows non-axial movement of carrier 43 when impact compresses the rubberoid member 41, within the confines determined by the much larger end bore 39 and the tapered limiter 52 acting against shaft 15 of assembly 33, 34, or 35 against this differing use of carrier 43 during impact-induced axial to non-axial movement of the completed dart 10 of this invention.

Barrel end 54 employs a differingly machined or formed thread bearer 55, from stainless steel or mild steel or brass, being locOtite received in states bores 56, 57, and incorporates a mirrored cylindrical buttress 58, an axial throughbore vent 59 connecting expansion chamber 39 to the weight receiving chamber 60; where, the end closure characteristics are shown by endcap 50, yet, any of the endcaps in FIG. 4 or those shown in U.S. Pat. No. 6,277,041 are applicable to this dart barrel under the "kit format".

Figures 5A, 5B, 6A, 6B, 6C:
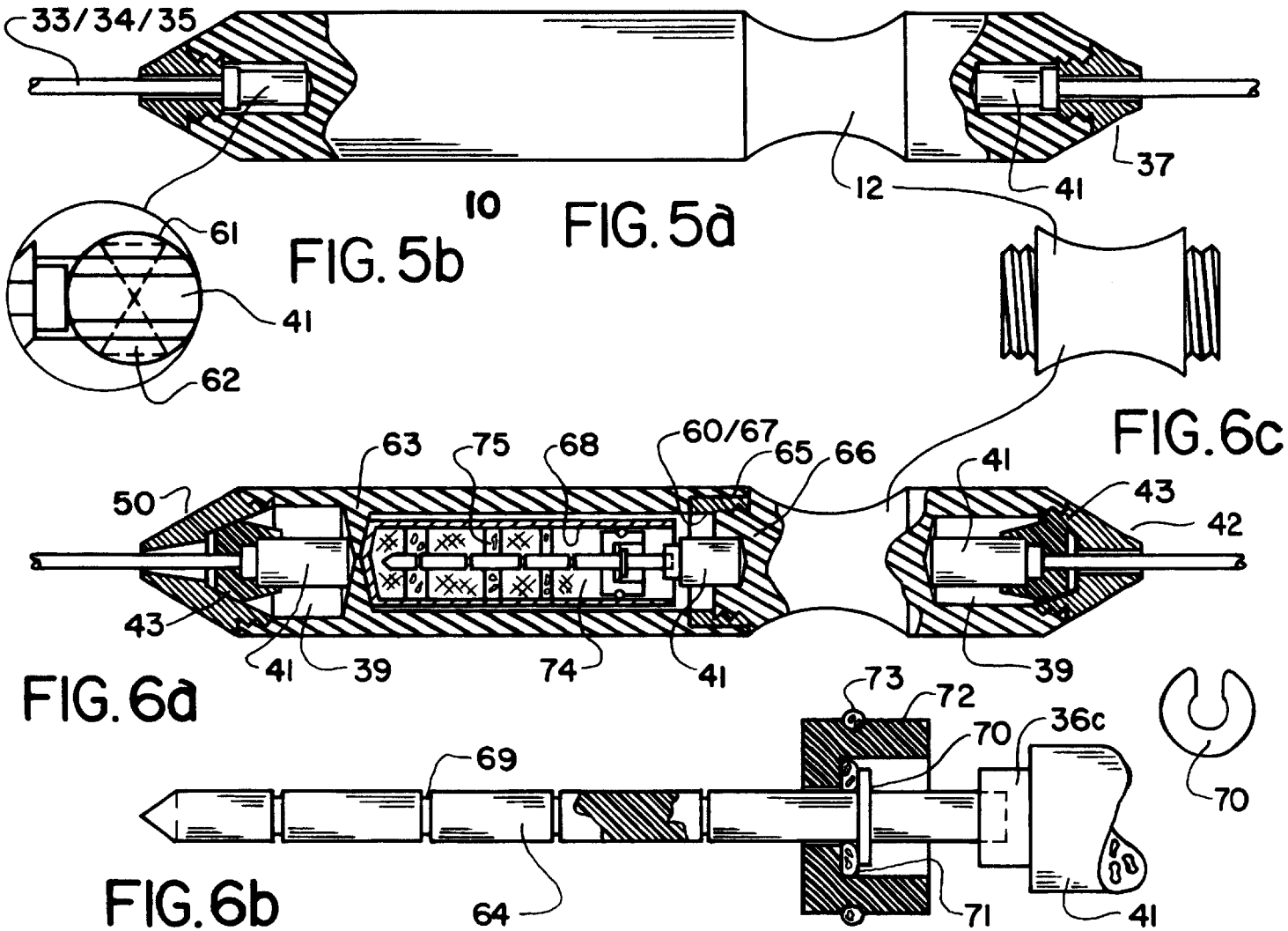
FIGS. 5*a* and 5*b* show partial cut-away views of the ends of the dart of this invention, as applied to a body of a prior art dart as shown in FIG. 1.
FIG. 6*a* shows partial cut-away views of variously assembled possible end component structures.
FIG. 6*b* shows a particulate tungsten powder carrier using a weight insert stick, being enlarged to correctly show the relationship of the parts.
FIG. 6*c* shows a thumb-notch attachment which also acts as a closure means to the chambers of the dart barrel.

FIG. 5*a,* without indicating which is the forward end containing the striking member, shows the simplified version of endcap 37 for incorporating this invention's assemblies at both ends of barrel 10; the grip positioner 12 that will establish either a fore or aft thrust bias created by end-user determination; and, an enlarged view of FIG. 5*b* of the enlarged view of resilient impact controller 41. In two dimensional format, FIG. 5*b* shows a spheroid 61 centered about a resilient body 41, and a conoid projection 62 that will establish the factors of toroidal genesis created by impact that allows body 41 to become oblate within the confines of bore 39, a condition that allows non-axial dispersal fo the impact force while continuing the point 14 contact that ignores impediments such as "spiders" 21 or another dart 10 thrown in close proximity, thereby increasing the opportunities for scoring in areas of small incidence, with this being known by the prior art term "hunting off of the wire".

FIG. 6*a,* which also is non-specific as to the forward end of barrel 11, employs endcaps 50 and 42 working with the appropriate components of carrier 43 and impact controller 41; but, the transsection of grip 12 allows the bore creation of weight chamber 60, ending in an internal buttress wall 63 inwardly of expansion chamber 39, thereby allowing an insertion of a differing weight stick 64 having a press fitted alternative 36*c* to enlarged collar end 36*a/b,* which can also be click mounted as shown in U.S. Pat. No. 6,277,041, that will abut a rubber spring stabilizer 41 upon rotational closure of the threaded end 66 of grip positioner 12 into a thread bearer 67 at the end of the weight chamber. Radially adjacent to those external threads is a cup receiver 45 for press fit insertion of the rubberoid member 41, it contacting the differing enlarged collar 36*c* of weight stick 64 when inserted into a spun cast aluminum tube 68; where, along this stick utilizes a series of annular slots 69 spaced along that shaft for receiving a circlip 70, intended to compress a rubberoid washer 71 against the internal face of a closure body 72, this end closure means having an outwardly placed O-ring 73 that prevents loss of the employed tungsten powder 74 that tubular carrier 68 captures therewithin. And note that the multiple use of varying widths of separators 75, of generally 40 Shore A rubber that closely surmounts stick 64, which are incrementally inserted onto stick 64 prior to press fitment of the enlarged collar 36*c*, they being utilized to separate the various charges of tungsten particulate, thereby allowing the end-user to determine not only the final weight of the finished dart but establish the personalized distribution of the weight in the carrier 68 of barrel 11. Further, take note that the weight insert is duplexedly insertable, thereby allowing the completed carrier 68 to establish either a fore or aft weighted condition of barrel 11 without changing the actual charges 74 or locations of partitions 75 that define said tungsten powder placements by the simple act of reversing the inserted end. FIG. 6*c,* given that the thumb-notch's overall shape being defined by the end-user, can be applied to either or both internal ends of barrel 11 against any possible use of axially reciprocal chambers, thereby furthering the personalization that this projectile in the game of darts can establish.

Figure 7:
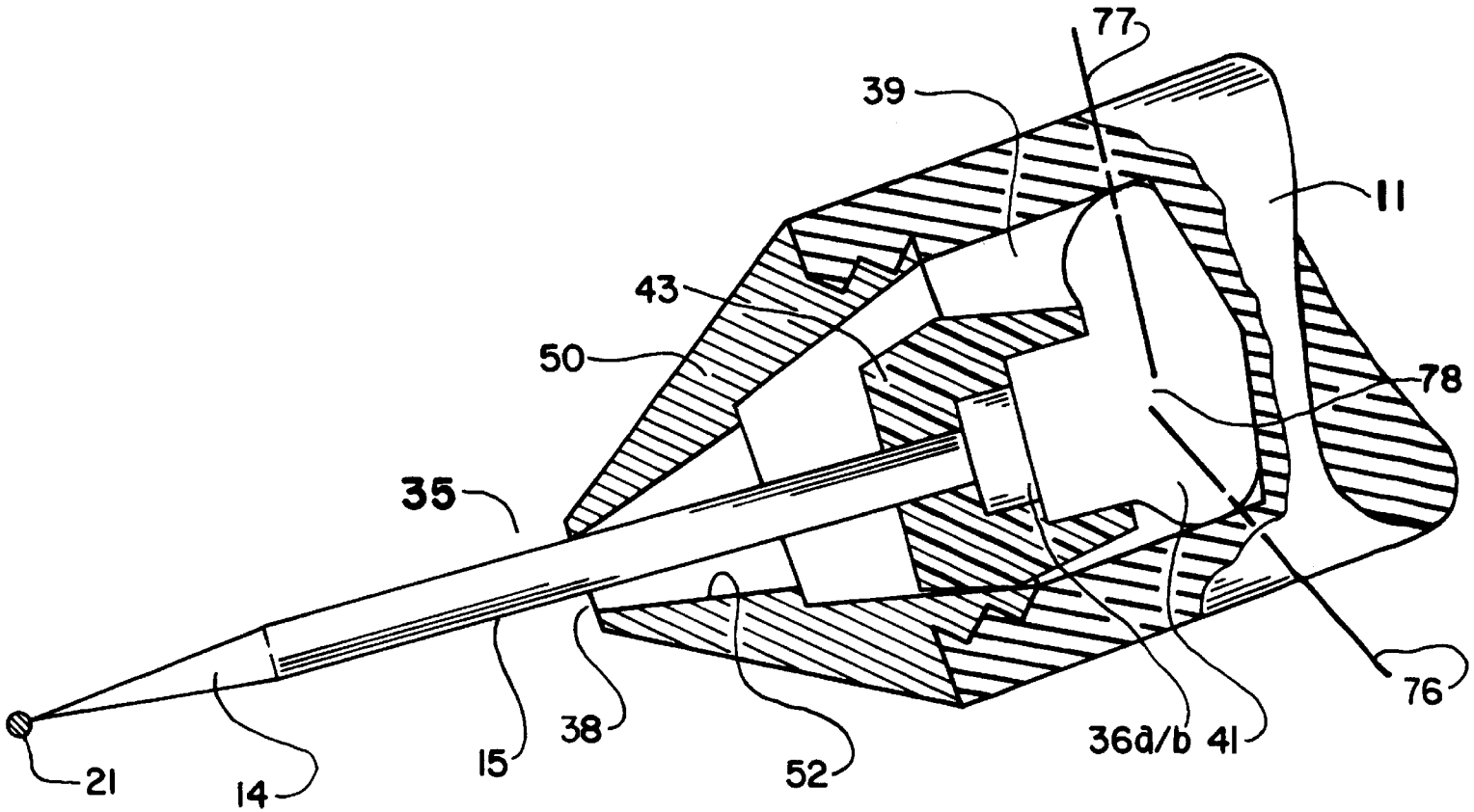
FIG. 7 shows an expanded view of the impact controlling portion of a dart impacting a "spider".

FIG. 7, being a partial cut-away of the forward end of this invention, shows the impact of scoring portion 14 of assembly 35 that references a steel tip dart intersecting "spiders" 21 in a sissal board, and displays in two dimensional format the reasoning for the utilization of a resilient rubber spring 41, which is consistent with the invention disclosed in U.S. Pat. No. 6,277,041. Carrier 43 employs not only the limiter aspects of end-opening 38 that is consistent with a slide-bore like shown at the ends of FIG. 4, and in FIGS. 5 and 6, but the enlarged bore that creates expansion chamber 39 and the forwardly subtending taper shown as 52 for endcap 50 of this invention.

While FIG. 5*b* displays a conoid projection 62 as being a toroidal extension from the center of mass for elastomeric cylinder 41, resulting in the distortion of spheroid 61 into an oblate configuration for resilient spring body 41 when impact occurs, this resulting from the axial constraints created by slide bore 38 and the minimal clearance of expansion chamber 39, FIG. 7 displays two divergent centers of non-axial mass occurring from said impact.

Radian 76 is relational to the axis of shaft 15, while radian 77 is relational to the axis and length of barrel 11 of this invention, with both being considered mass iteratives relative to the speed and arc of the thrown projectile during the pico-second of activity; whereas, skewed locus 78, being the separation between the two active centripetal characterizations of 76 and 77, can be categorized as a wave harmonic at the surface of spheroid 62 shown in FIG. 5*b,* and was noted as an "arc-of incidence" in U.S. Pat. No. 6,277,041. It is this ability to distortional values, along differing force directions during the management established by the cylindrical rubber spring 41 of this invention, that creates the stipulated "hunting off of the wire" that every dart player desires.

And while this portrayal involves the steel tip embodiment, and is cross-relational to the soft tip embodiment of darts, it also can be directly applied to the back end of this invention at the stipulated factor of not less than a "power of seven" without any loss of capability, thereby furthering the utility inherent with the utilization of a cylindrical spring member created from a silicone derivative of 40 Shore A to 70 Shore A, as axial to non-axial distortion is what this invention manages in a simplified format that the end-user can manipulate in a "mix and match" kit format; where, only a few of the possible variations have been illustrated herein. This will provide a player with the ability to build highly customizable darts which have a reduced tendency for target rejection, and reduced deflection of subsequently thrown darts. This is considered an advantage not possible with prior art dart constructions. Accordingly, the invention is not limited by the illustrations and examples in the specification, but only by the following claims.

What is claimed is:

1. A dart, comprising:

a barrel having an axis and first and second ends, and a bore opening into at least one end, said bore being parallel to the axis, said bore ending in a concave wall within the barrel, and having internal threads surrounding at least a portion of said bore;

an end cap having external threads for engagement with said internal threads of said bore, said end cap having a through passage along said axis when the end cap is engaged with the bore;

a dart shaft assembly, having a shaft portion, and a collar at one end, the shaft portion slidably received within said through passage of said end cap, and extending away from the dart barrel; the collar of a size too large to pass through said through passage, the collar retained between the end cap and concave wall;

an elastomeric cylinder received in the bore, and in compressive contact between the concave wall and collar when the end cap is threadedly engaged in the bore, the elastomeric cylinder having a diameter, and the bore having a diameter greater than the elastomeric cylinder, to allow side-to side flexure of the elastomeric cylinder relative to said axis, in response to forces applied to said dart shaft which can be both parallel and non-parallel to said axis.

2. The dart of claim 1, further comprising a carrier received between the end cap and concave wall, the end cap having a nest portion to receive a portion of the carrier, the carrier having a through bore in alignment with the through passage of the end cap, which opens to a staged bore of a size to closely receive the collar of said shaft assembly, which opens to a cylinder bore to closely receive an end of said elastomeric cylinder.

3. The dart of claim 2, where the through passage of the end cap is of substantially constant diameter along the length of the end cap.

4. The dart of claim 2, where the through passage of the end cap is of increasing diameter along its length, toward the dart barrel, to allow substantial angular movement of the dart shaft received therein, in response to forces applied thereto which are non-parallel to the axis.

5. The dart of claim 1, where the shaft portion of the shaft assembly is a scoring member, adapted to be received in a dart board.

6. The dart of claim 1, where the shaft portion of the shaft assembly is a flight shaft for receiving feathers or vanes.

7. The dart of claim 1, in which a bore is formed into both the first and second end of the dart barrel.

8. The dart of claim 1, further including a hollow interior for receiving a weight member.

9. The dart of claim 8, in which said concave wall is a buttress wall, separating said bore from said hollow interior.

10. The dart of claim 1, further including an indented grip member provided on the barrel.

11. The dart of claim 10, in which the barrel is split into a forward section and a rearward section, the forward section of the barrel having a rearward opening cavity with interior threads, the rearward section of the barrel having a forward opening cavity with interior threads; and said indented grip member having a forward section with exterior threads to engage said interior threads of said rearward opening cavity, and a rearward section with exterior threads to engage said interior threads of said forward opening cavity.

12. The dart of claim 1, in which said concave wall and internal threads are provided by means of a thread-bearer insert, which is fixedly received in a hollow end of the barrel.

13. The dart of claim 12, in which the barrel includes a hollow interior; and in which at least one end of the barrel includes a said concave wall and internal threads, which are provided by means of said thread-bearer insert, which is fixedly received in a hollow end of the barrel.

14. The dart of claim 13, which may be assembled as a kit, by providing a said barrel, a weight member, at least one said thread-bearer insert, at least one said end cap, at least one said dart shaft assembly, and at least one said elastomeric cylinder; inserting said weight member within the hollow barrel, attaching a thread-bearer insert to at least one end of the barrel to retain the weight member within the barrel; and assembling an end cap, dart shaft assembly, and elastomeric cylinder to a respective thread-bearer insert.

15. The dart of claim 14, which further includes as a component of the kit, at least one carrier for a respective dart shaft assembly, received between a respective end cap and concave wall.

* * * * *